US005153544A

United States Patent [19]

Castonguay et al.

[11] Patent Number: 5,153,544

[45] Date of Patent: Oct. 6, 1992

[54] MOLDED CASE CIRCUIT BREAKER FIELD-INSTALLABLE ACCESSORIES

[75] Inventors: Roger N. Castonguay, Terryville; David Arnold, Chester, both of Conn.

[73] Assignee: General Electric Company, New York, N.Y.

[21] Appl. No.: 819,702

[22] Filed: Jan. 13, 1992

Related U.S. Application Data

[62] Division of Ser. No. 653,531, Feb. 11, 1991, Pat. No. 5,117,210.

[51] Int. Cl.[5] ..... H01H 9/20

[52] U.S. Cl. ..... 335/167; 335/172

[58] Field of Search ..... 335/17, 131-133, 335/202, 167-176

[56] References Cited

U.S. PATENT DOCUMENTS

| | | | |
|---|---|---|---|
| 4,595,812 | 6/1986 | Tamaru et al. | 335/132 |
| 4,622,444 | 11/1986 | Kandatsu et al. | 335/132 |
| 5,036,303 | 7/1991 | Papallo et al. | 335/202 |

*Primary Examiner*—Lincoln Donovan
*Attorney, Agent, or Firm*—Richard A. Menelly

[57] ABSTRACT

Field-installable accessories are used within a thermal-magnetic industrial-rated circuit breaker. One such accessory in the form of a combined undervoltage release and shunt trip unit is field-installable within the circuit breaker cover. A bell alarm accessory unit can also be inserted within the circuit breaker cover either in combination with or apart from the undervoltage-shunt trip accessory unit.

5 Claims, 4 Drawing Sheets

MOLDED CASE CIRCUIT BREAKER FIELD-INSTALLABLE ACCESSORIES

This is a divisional, of application Ser. No. 07/653,531, filed Feb. 11, 1991, U.S. Pat. No. 5,117,810.

BACKGROUND OF THE INVENTION

U.S Pat. No. 4,754,247 describes an industrial-rated circuit breaker utilizing an electronic trip unit to articulate the circuit breaker operating mechanism upon the occurrence of an overcurrent condition through a protected circuit. The circuit breaker includes an accessory cover that allows field as well as factory installation of selected circuit breaker accessories by providing access to the accessory recesses formed within the circuit breaker cover without affecting the integrity of the circuit breaker operating components contained within the circuit breaker case.

An actuator-accessory unit such as described in U.S. Pat. No. 4,788,621 provides undervoltage release as well as shunt trip function to such circuit breakers when mounted within the accessory recess. U.S. Pat. No. 4,939,490 describes a bell alarm unit accessory that is often used in combination with the aforementioned undervoltage release and shunt trip accessory unit.

U.S. patent application Ser. No. 650,275 entitled "Molded Case Circuit Breaker Thermal-Magnetic Trip Accelerator" describes an industrial-rated circuit breaker employing a thermal-magnetic trip unit for articulating the circuit breaker operating mechanism upon the occurrence of overcurrent conditions within a protected circuit. The aforementioned U.S. Pat. No. 4,754,247 employing an electronic trip unit simplifies the use of such accessories by virtue of electronic communication with the actuator-accessory unit that is contained within the accessory recess. The thermal-magnetic trip unit used within the aforementioned U.S. patent application Ser. No. 150,776 does not provide an electronic output and hence the accessories must be capable of directly articulating the circuit breaker operating mechanism, per se.

Accordingly, one purpose of the invention is to describe circuit breaker accessory units that are both field and factory installable within such industrial-rated circuit breakers employing thermal-magnetic trip units.

SUMMARY OF THE INVENTION

A standard undervoltage release-shunt trip accessory unit and standard bell alarm unit are employed within industrial-rated circuit breakers equipped with thermal-magnetic trip units. The trip bar within the circuit breaker operating mechanism is adapted to respond to a mechanical actuator located within the circuit breaker cover and extending within the circuit breaker case. The mechanical actuator displaces the trip bar to articulate the operating mechanism and separate the circuit breaker contacts upon release by the accessory unit. The trip bar, in turn, activates the bell alarm unit to indicate to a remote operator that the circuit breaker contacts have been separated.

DESCRIPTION OF THE PREFERRED EMBODIMENT

Figure 1:
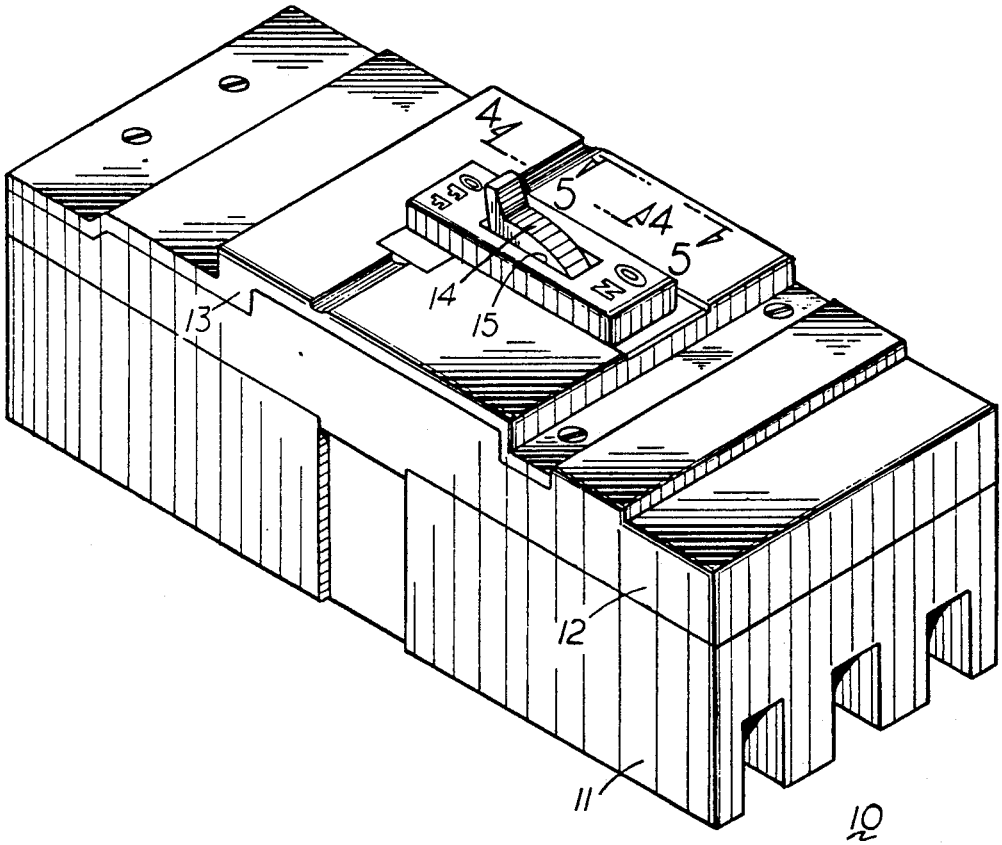
FIG. 1 is a top perspective view of a molded case industrial-rated circuit breaker employing a thermal-magnetic trip unit, an undervoltage-shunt trip and a bell alarm accessory in accordance with the invention.

An industrial-rated circuit breaker 10, as shown in FIG. 1, includes a plastic case 11 to which a plastic cover 12 is fixedly secured. An accessory cover 13 as described in aforementioned U.S. Pat. No. 4,754,247 is hingeably attached to the cover and a handle operator 14 extends through a slot 15 formed in the circuit breaker cover.

Figure 2:
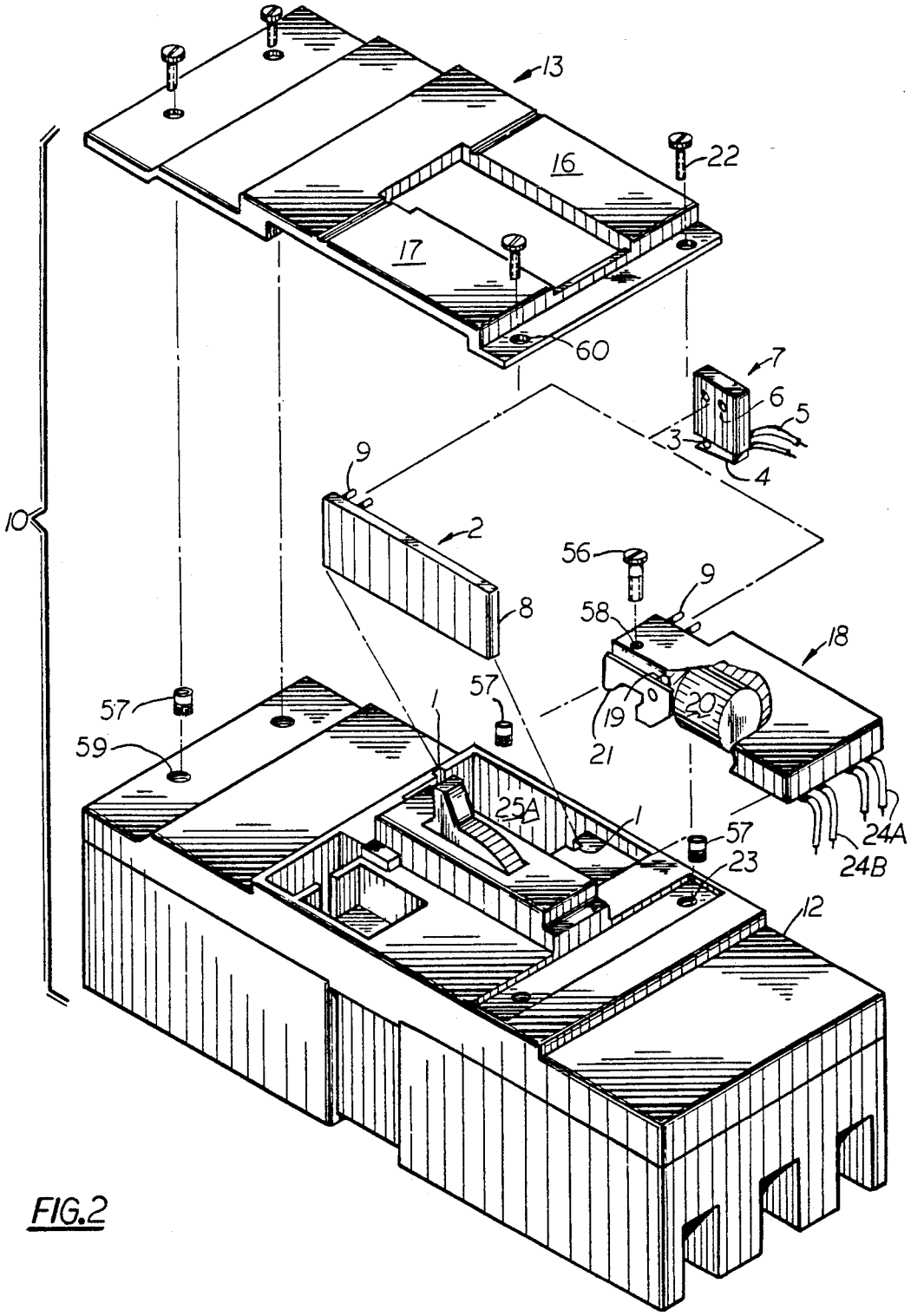
FIG. 2 is a top perspective view of the circuit breaker of FIG. 1 prior to installation of the circuit breaker accessories.

The circuit breaker 10 is depicted in FIG. 2 prior to insertion of the undervoltage release-shunt trip accessory unit 18 within the accessory recess 25A formed in the circuit breaker cover 12. The undervoltage release-shunt trip accessory unit hereafter "accessory unit" is similar to that described within aforementioned U.S. Pat. No. 4,788,621 and includes a trip latch 21 controlled by an armature 19 and electromagnet 20. Upon receipt of an external voltage pulse over the wire conductors 24A, a shunt trip function is performed by energizing the electromagnet and causing the trip latch 21 to release. An undervoltage release occurs when the voltage applied to the wire conductors 24B drops to a value less than that required to hold the electromagnet 20 and restrain the electromagnet from releasing the trip latch. A bell alarm unit 7 includes a switch button 3 connecting with a microswitch contained within the bell alarm unit and is acted upon by means of a flat spring 4 arranged against the switch button 3 whereby release of the switch button closes the microswitch within the bell alarm thereby transmitting a signal over the bell alarm wire conductors 5 to a remote location. The bell alarm operates in the manner described in aforementioned U.S. Pat. No. 4,939,490. The bell alarm is attached to the accessory unit 18 by capturing the posts 9 extending from the bell alarm unit within corresponding apertures 6 formed within the bell alarm unit. In applications not requiring an accessory unit 18, the bell alarm unit is mounted within the accessory recess 25A by means of the bell alarm card 2 containing similar bell alarm posts 9. The bell alarm card is in the form of a fiber or plastic rectangle 8 that sits within the accessory recess 25A by inserting the ends of the card within a pair of opposing slots 1 formed in the opposite edges of the recess. An auxiliary switch accessory unit (not shown) can be inserted within the accessory recess 25B formed within the circuit breaker cover 12 on the side of the circuit breaker cover 12 opposite the accessory recess 25A. The accessory unit 18 is fixedly secured within the side edge of the accessory recess 25A by first placing a threaded metal insert 57 within an aperture formed within the side edge of the accessory recess and then positioning a screw 56 through an opening 58 formed on the edge of the accessory unit 18 as indicated. The metal inserts allow the accessory unit to be removed and re-installed without damage to the plastic aperture formed in the side edge of the recess. The accessory cover 13 is next attached to the circuit breaker cover by employing similar metal inserts 57, screws 22, and openings 23, 59, 60 as indicated. Access to the accessory unit 18 and bell alarm unit 7 is made through the accessory door 16 while access to the auxiliary switch recess is made by means of the accessory door 17.

Figure 3:
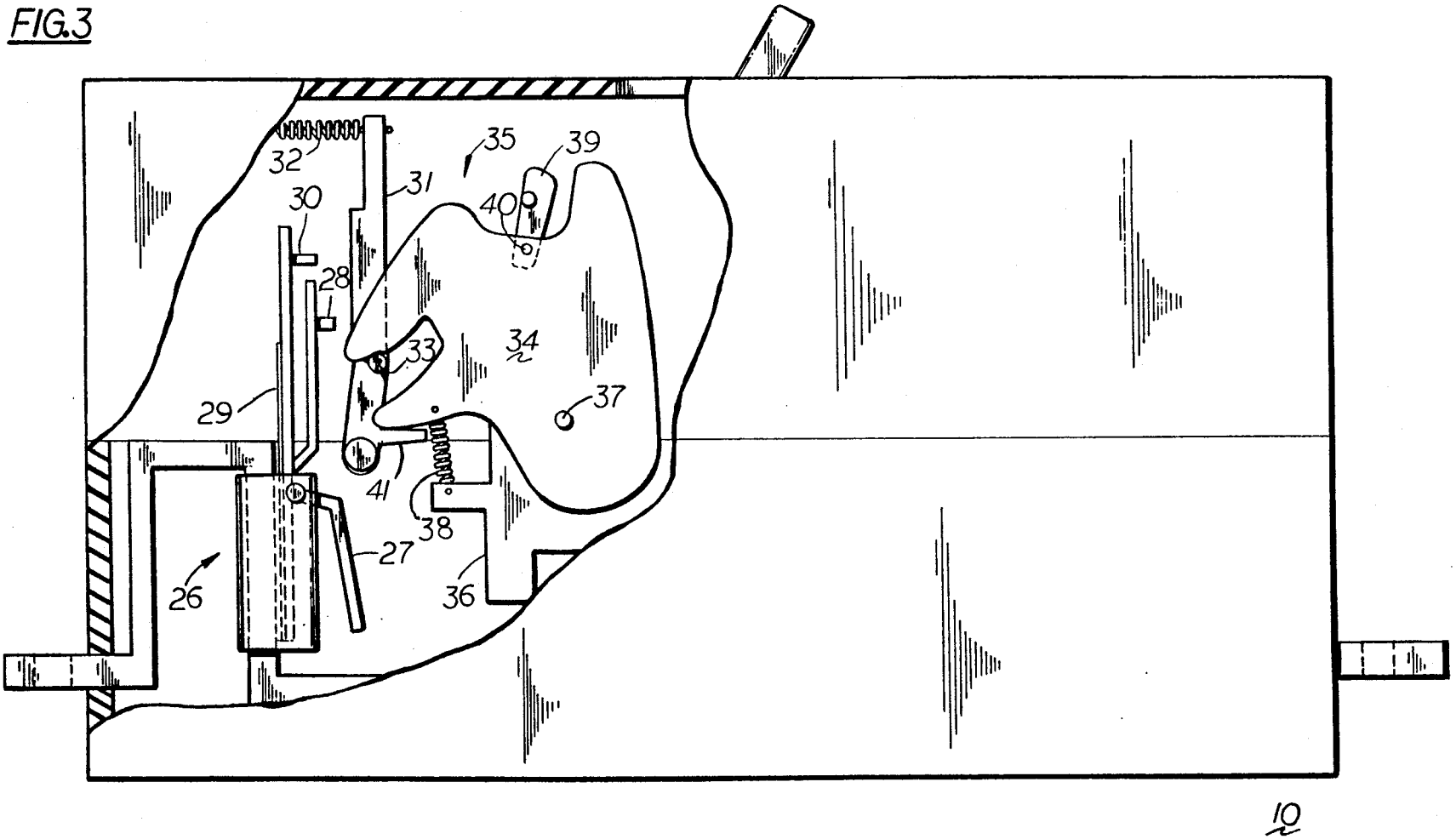
FIG. 3 is a side view of the circuit breaker of FIG. 1 with part of the cover and case removed to depict the thermal-magnetic trip unit contained therein.

As described within the aforementioned U.S. patent application Ser. No. 150,275, the circuit breaker 10 shown in FIG. 3 includes a trip accelerator in the form of a trip lever 34 pivotally mounted to the operating mechanism side frame 36 by means of the pivot pin 37. The operating mechanism shown generally at 35 includes a secondary latch 39 which is pivotally mounted to the operating mechanism side frame by means of the pivot post 40. The thermal-magnetic trip unit 26 is arranged such that the pivotally mounted armature 27 drives the magnetic trip post 28 against the trip bar 31 upon the occurrence of a short circuit overcurrent condition through the circuit breaker contacts (not shown). The bi-metal 29 responds to overcurrent conditions less than short circuit magnitude to drive the thermal trip post 30 against the trip bar and thereby dislodge the trip post 33 from the trip lever 34 and allows rapid rotation of the trip lever counterclockwise about pivot 37 into contact with the secondary latch 39 to release the secondary latch and thereby articulate the operating mechanism. The trip lever and the operating mechanism are reset in the manner fully described within,. the aforementioned U.S. patent application No. 150,275, which returns the trip lever back against the trip post 33 where it is held by the bias provided by the trip lever spring 38 and the trip bar spring 32. The trip paddle 41 extends from the trip bar 31 and responds to articulate the operating mechanism independent of the thermal-magnetic trip unit 26 as explained below in greater detail.

Figure 4:
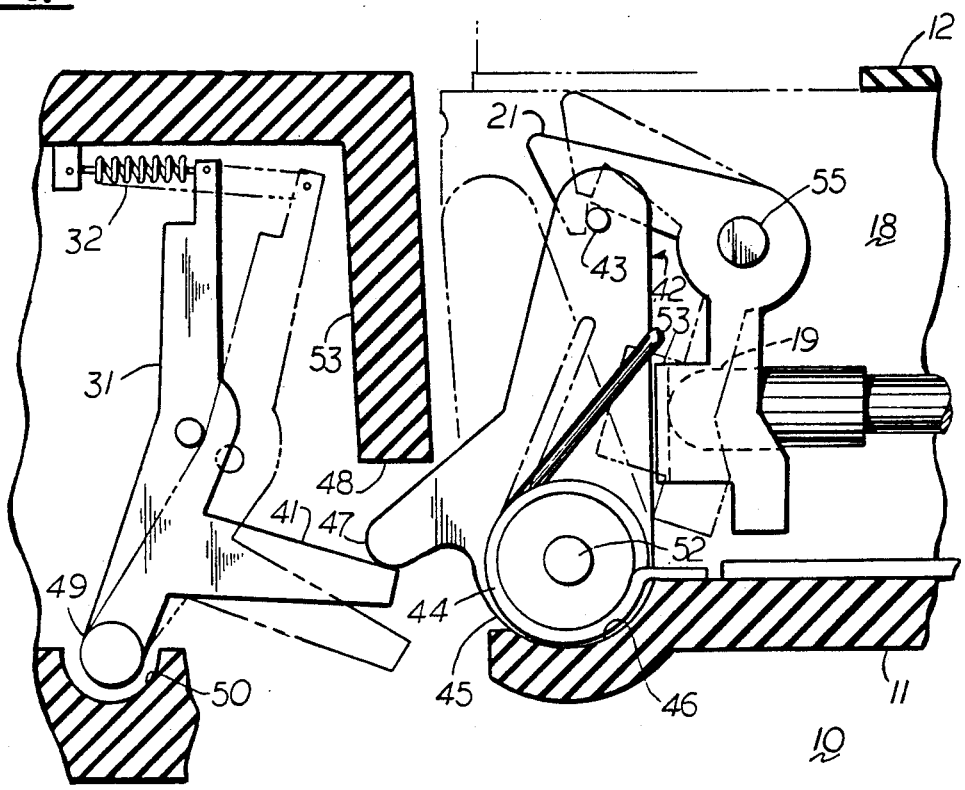
FIG. 4 is an enlarged side view in partial section of the circuit breaker of FIG. 3 depicting the operation of the undervoltage-shunt trip accessory.

The circuit breaker 10 is shown in FIG. 4 with part of the circuit breaker case 11 and cover 12 removed to show the interaction between the mechanical actuator 42 positioned within the circuit breaker cover by placement of the radial end 45 of the mechanical actuator within the corresponding radial bearing surface 46 formed in the bottom of the circuit breaker cover 12. The trip lever 34 shown earlier in FIG. 3 sits in front of the mechanical actuator and is omitted from FIG. 4 to more clearly depict the interaction between the mechanical actuator and the trip paddle 41 on the trip bar 31. A slot 48 is provided through the inner wall 53 of the cover 12 to allow the actuator arm 47 extending from the mechanical actuator to contact the trip paddle 41 formed at the bottom of the trip bar. The trip bar also includes a curved end 49 that sits within the radial bearing surface 50 formed in the bottom of the circuit breaker case 11 to allow the trip bar to rotate clockwise against the return bias provided by the trip bar spring 32. As fully described in U.S. Pat. No. 4,806,893, the mechanical actuator is restrained from rotating in the counterclockwise direction under the bias of the powerful mechanical actuator spring 44 about the mechanical actuator pivot post 52 by means of engagement by the trip latch 21 of the latch pin 43 extending from the mechanical actuator. The trip latch is, in turn, controlled by the operation of the armature 19 that is part of the accessory unit 18 described earlier with reference to FIG. 2. Independent of the electromagnetic trip unit, the accessory unit 18 responds to project the armature 19 against the latch bar 54 which, in turn, rotates the trip latch 21 clockwise about the trip latch pivot post 55 to thereby release the latch pin 43 on the mechanical actuator and drive the actuator arm 47 against the trip paddle 41 causing the trip bar 31 to rotate in the clockwise direction, all as indicated in phantom. The rotation of the trip bar accordingly articulates the circuit breaker operating mechanism to separate the circuit breaker contacts as fully described in the aforementioned U.S. patent application Ser. No. 150,275.

Figure 5:
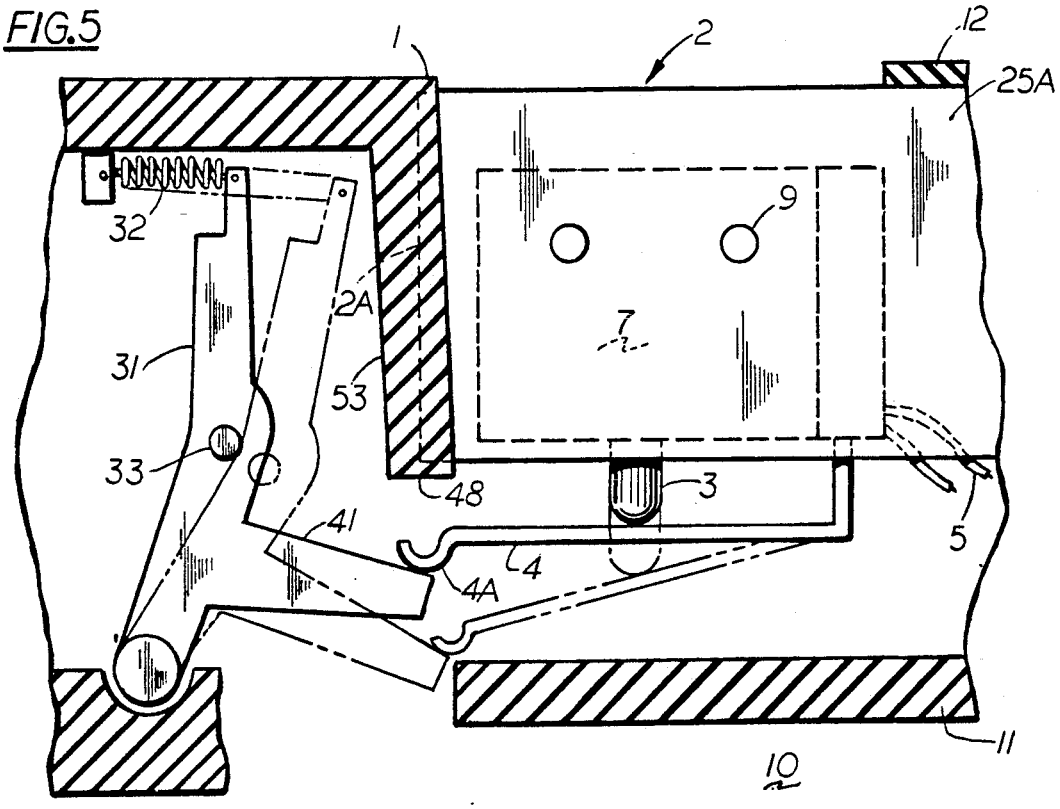
FIG. 5 is an enlarged side view in partial section of the circuit breaker of FIG. 3 depicting the operation of the bell alarm accessory.

The circuit breaker 10 is depicted in FIG. 5 with part of the case 11 and cover 12 removed to shown the bell alarm unit 7 mounted within the accessory recess 25A by means of the bell alarm card 2 which is inserted at its ends within the corresponding slots 1 formed within the inner wall 53 of the circuit breaker cover 12 as indicated at 2A. The bell alarm is supported upon the bell alarm posts 9 extending from the bell alarm card and is arranged such that the switch button 3 extending from the bottom of the bell alarm abuts the flat spring 4 such that the curved end 4A of the flat spring abuts against the trip paddle 41 on the trip bar 31. The curved end 4A of the flat spring extends within the slot 48 formed at the bottom of the inner wall 53 of the circuit breaker cover in a similar manner as described with the accessory unit 18 shown earlier in FIG. 4. When the trip bar 31 has rotated in a clockwise direction by action of the thermal-magnetic trip unit 26 depicted in FIG. 3 or by action of the accessory unit 18 depicted in FIG. 4 to drive the trip bar 31 and attached trip post 33 in the clockwise direction against the bias of the trip bar spring 32, as shown in phantom, the trip paddle allows the spring loaded switch button 3 to move with the spring 4 and thereby actuate the microswitch (not shown) contained within the bell alarm 7 to indicate to a remote observer by means of the wire conductors 5 that such a tripping operation has occurred. The bell alarm unit is automatically reset upon return of the trip bar 31 to its initial position by the reset operation described within the aforementioned U.S. patent application Ser. No. 150,275 when the operating mechanism 35 of FIG. 3 becomes reset.

Accessory units such as a combined undervoltage-shunt trip accessory and a bell alarm accessory have herein been described as operational with thermal-magnetic trip units. Both the undervoltage-shunt trip accessory and the bell alarm accessory are field-installable as well as factory-installable.

Having thus described our invention, what we claim as new and desire to secure by Letters Patent is:

1. A mold case circuit breaker comprising:

a plastic circuit breaker case and cover;

an operating mechanism within said case, said operating mechanism including a latch lever, restraining said operating mechanism from separating a pair of contacts within said case during quiescent current conditions with a protected circuit;

an operating handle extending through said cover at one end and connecting with said operating mechanism at an opposite end, said operating handle opening and closing said contacts during said quiescent current conditions;

a thermal-magnetic trip unit within said case arranged for displacing a trip bar and articulating said operating mechanism to separate said contacts upon occurrence of overcurrent conditions through said protected circuit;

a bell alarm accessory unit within said cover interacting with said thermal-magnetic trip unit to provide external indication of said contact opening;

a trip lever interacting with said thermal-magnetic trip unit and said operating mechanism for articulating said operating mechanism upon occurrence of said overcurrent conditions; and a trip paddle extending from a bottom of said trip bar and a spring extending from said bell alarm, said spring being positioned at an inactive position by said trip paddle when said contacts are closed and said spring being positioned at an active position by said paddle when said contacts are opened.

2. The circuit breaker of claim 1 including a switch button extending from a bottom of said bell alarm intermediate said bell alarm bottom and said spring, said spring contacting said switch button to inactuate said bell alarm and said spring releasing said switch button to actuate said bell alarm when said contacts move from closed to open conditions.

3. The circuit breaker of claim 1 including an accessory cover hingeably attached to said circuit breaker cover providing access to said bell alarm without removing said circuit breaker cover.

4. The circuit breaker of claim 1 including an insulative support having means thereon for supporting said bell alarm accessory unit within said cover.

5. The circuit breaker of claim 1 wherein said support means comprises a pair of posts extending from said support within a corresponding pair of holes formed within said bell alarm accessory unit.

* * * * *